US009677280B2

(12) United States Patent
Canales

(10) Patent No.: US 9,677,280 B2
(45) Date of Patent: Jun. 13, 2017

(54) METHOD OF INSTALLING A WIND-RESISTANT ROOF UNDERLAYMENT

(71) Applicant: Jose Lucio Canales, Bushkill, PA (US)

(72) Inventor: Jose Lucio Canales, Bushkill, PA (US)

( * ) Notice: Subject to any disclaimer, the term of this patent is extended or adjusted under 35 U.S.C. 154(b) by 0 days.

(21) Appl. No.: 14/639,680

(22) Filed: Mar. 5, 2015

(65) Prior Publication Data

US 2016/0258164 A1 Sep. 8, 2016

(51) Int. Cl.
*E04D 5/14* (2006.01)
*E04D 5/00* (2006.01)

(52) U.S. Cl.
CPC *E04D 5/00* (2013.01); *E04D 5/14* (2013.01)

(58) Field of Classification Search
CPC E04D 12/002; E04D 5/02; E04D 5/10; E04D 5/12; E04D 5/148; E04D 5/146
See application file for complete search history.

(56) References Cited

U.S. PATENT DOCUMENTS 2,222,868 A * 11/1940 Hollister ..... E04D 5/10 428/143
3,001,500 A 9/1961 Pinnes et al.
3,001,501 A 9/1961 Rede et al.
3,292,334 A * 12/1966 Willis ..... E04D 5/10 428/142
3,326,366 A * 6/1967 Butterfield ..... E04D 5/10 427/417
4,992,315 A * 2/1991 Zickell ..... B32B 11/02 428/141
6,235,365 B1 * 5/2001 Schaughency ..... E04D 5/12 428/114
6,426,129 B1 * 7/2002 Kalwara ..... C09J 7/0253 428/40.3
6,619,006 B1 9/2003 Shirota
6,701,685 B2 * 3/2004 Rippey ..... E04D 5/12 428/40.1
7,234,284 B2 * 6/2007 Paradise ..... C08L 95/00 156/72
7,368,155 B2 5/2008 Larson et al.
7,685,785 B2 3/2010 Johnson
7,765,763 B2 8/2010 Teng et al.
(Continued)

FOREIGN PATENT DOCUMENTS

WO WO9940271 A1 8/1999

*Primary Examiner* — Elizabeth A Quast
(74) *Attorney, Agent, or Firm* — The Concept Law Group, P.A.; Scott D. Smiley; Erin A. Martin

(57) ABSTRACT

A method of installing a wind-resistant roof underlayment is disclosed that includes providing a wind-resistant roof underlayment having a lower surface including an adhesive medium. The wind-resistant roof underlayment includes an upper surface having a first non-release liner portion with a width of at least three inches. A second release liner portion is provided having a width of at least eight inches. The second release liner portion is disposed in an overlapping relationship with an upper surface adhesive medium coupled to the upper surface. The method includes coupling the lower surface to a roof deck, with a portion of the second release liner portion at a position substantially adjacent to an eave of the roof deck, removing the second release liner portion, thereby exposing an adhesive strip of the upper surface adhesive medium, and coupling a plurality of shingles to the strip of the upper surface adhesive medium.

19 Claims, 8 Drawing Sheets

(56) References Cited

U.S. PATENT DOCUMENTS

| | | | | |
|---|---|---|---|---|
| 2002/0121061 | A1 | 9/2002 | Rippey | |
| 2003/0032356 | A1* | 2/2003 | Kiik | A47G 27/0468 442/327 |
| 2003/0070391 | A1* | 4/2003 | Tachauer | A44B 18/0049 52/745.21 |
| 2003/0219563 | A1 | 11/2003 | Zanchetta et al. | |
| 2003/0230040 | A1* | 12/2003 | Shirota | E04D 1/26 52/302.1 |
| 2005/0126103 | A1* | 6/2005 | Scheirer | E04D 5/12 52/518 |
| 2006/0096218 | A1* | 5/2006 | Johnson | E04D 12/002 52/506.01 |
| 2007/0068109 | A1 | 3/2007 | Swann | |
| 2010/0307087 | A1 | 12/2010 | Zoellner | |
| 2011/0033685 | A1 | 2/2011 | Folkersen | |
| 2011/0104484 | A1 | 5/2011 | Ford | |
| 2014/0037882 | A1 | 2/2014 | Georgeau et al. | |
| 2015/0176282 | A1* | 6/2015 | Baker | E04D 12/002 52/716.2 |

* cited by examiner

METHOD OF INSTALLING A WIND-RESISTANT ROOF UNDERLAYMENT

FIELD OF THE INVENTION

The present invention relates generally to a method for installing a roof underlayment, and more particularly, relates to a method for installing a wind-resistant roof underlayment having an upper and lower adhesive medium.

BACKGROUND OF THE INVENTION

It is well known that roof installation is a meticulous and time consuming process. Certain geographical regions have set forth building codes governing the roof installation process. In one example, the Florida Building Code's Roofing Application Standard (RAS) No. 115, section 6.1, established in 2010, requires shingles and starter strips at the perimeter, i.e., eave of the roof deck to be set in a minimum eight inch wide strip of roofing cement. The roofing cement may be applied over an underlayment. The starter strips, or "starter course," is important to those known roof installation methods as it is an additional underlayment applied to an already existing underlayment layup that is specifically designed to inhibit vertical forces on roof structures caused by wind. As the starter course is one various underlayment below the roofing structure, there is a higher likelihood of delamination and failure between the layup of underlayments.

Once the roofing cement is applied, shingles are laid over the roofing cement and nailed into the roof. The roofing cement is required at the eave because the roofing shingles are most susceptible to flying from the roof at this location when subjected to heavy wind. When the roofing cement is exposed to heat, the roofing cement acts as an adhesive to bind the shingles to form a waterproof barrier. The Florida Building Code in particular requires the roofing cement to have a maximum thickness of ⅛ of an inch, as excessive cement may cause blistering, or bleed through. As such, applying the roofing cement must be performed with caution so as prevent blistering or bleed through.

The use of the roofing cement during the roof installation process is a time consuming, hazardous, and inefficient method of roof installation. The initial coat of the roofing cement must be applied to the roof with the maximum thickness as set forth in the particular geographic location. If additional coats of the roofing cement are needed, the installer must wait approximately twelve hours for the initial coat to dry before applying an additional coat. As a result, this process often results in costly labor expenses. This is also problematic for installation jobs that occur during inclement weather.

Those installing the roof must be careful not to step on the roofing cement that may bind to the installer's shoes, the air hoses connected to the nails gun, and the like. The roofing cement may also become slippery, causing the installer to slip and fall. As an added problem, the insufficient adhesive properties of the roofing cement often result in the shingles flying from the roof during periods of high velocity wind, e.g., the wind produced by hurricane storms in states such as Florida.

Therefore, a need exists to overcome the problems with the prior art as discussed above.

SUMMARY OF THE INVENTION

The invention provides a method of installing a roof using a wind-resistant underlayment having dual layers of adhesive that overcomes the hereinafore-mentioned disadvantages of the heretofore-known devices and methods of this general type and that provides a lower surface that binds directly to a roof and an upper surface that binds to a plurality of shingles.

With the foregoing and other objects in view, there is provided, in accordance with the invention, a method of installing a wind-resistant roof underlayment that includes providing a wind-resistant roof underlayment. The wind-resistant roof underlayment includes a lower surface having a lower surface adhesive medium and a lower surface release liner coupled thereto. The wind-resistant roof underlayment also includes a first non-release liner portion spanning a longitudinal length of the wind-resistant roof underlayment, having a width of the wind-resistant roof underlayment of at least three inches. The wind-resistant roof underlayment further includes a second release liner portion spanning a longitudinal length of the wind-resistant roof underlayment, having a width of the wind-resistant roof underlayment of at least eight inches, and disposed in an overlapping relationship with an upper surface adhesive medium. An inner core is interposed between the lower and upper surfaces. The method includes removing the lower surface release liner and coupling the lower surface of the wind-resistant roof underlayment to a roof deck, with a portion of the second release liner portion at a position substantially adjacent to an eave of the roof deck. The method continues by removing the second release liner portion, thereby exposing an adhesive strip of the upper surface adhesive medium; and coupling a plurality of shingles to the adhesive strip of the upper surface adhesive medium.

In accordance with a further feature of the present invention, the lower surface of the wind-resistant roof underlayment is directly coupled to the roof deck.

In accordance with another feature of the present invention, the wind-resistant roof underlayment includes an upper edge and a lower edge separated by the width of the wind-resistant roof underlayment, the lower surface adhesive medium spanning the width from the upper edge to the lower edge and spanning the longitudinal length of the wind-resistant roof underlayment.

In accordance with yet another feature of the present invention, the method includes positioning the lower edge of the wind-resistant roof underlayment at the eave of the roof deck.

In accordance with another feature of the present invention, the method includes applying a secondary underlayment in an adjacent relationship with the first non-release liner portion, wherein the secondary underlayment is a water impermeable material.

In accordance with another feature of the present invention, the first non-release liner portion and the second release liner portion are separated by a recessed partition.

In accordance with a further feature of the present invention, the first non-release liner portion and the second release liner portion are separated by a substantially level partition.

In accordance with another feature of the present invention, the method includes applying a plurality of secondary underlayments to substantially cover the roof deck before removing the second release liner portion.

In accordance with yet another feature of the present invention, the wind-resistant roof underlayment has a substantially uniform thickness.

The present invention, according to another embodiment, includes a method of installing a wind-resistant roof underlayment, where the method includes providing a wind-resistant roof underlayment having a lower layer including an adhesive element disposed continuously along a length of the wind-resistant roof underlayment and a release liner covering the lower layer. The wind-resistant roof underlayment includes an upper layer having a first section including a width of at least three inches, a second section having a width of at least eight inches, a release liner covering the second section, and a partition separating the first section and the second section. An adhesive element is coupled to the second section and disposed continuously along the length of the wind-resistant roof underlayment. The method includes coupling the lower layer to a roof deck at an eave of the roof deck; removing the release liner from the second section; and coupling a plurality of shingles to the second section.

In accordance with another feature of the present invention, the lower layer is directly selectively coupled to the roof deck.

In accordance with another feature of the present invention, the method includes providing a secondary underlayment different than the wind-resistant roof underlayment; and applying the secondary underlayment adjacent the first section of the wind-resistant roof underlayment.

In accordance with yet another feature of the present invention, the secondary underlayment is at least one of an ice-and-water shield and a felt paper.

In accordance with another feature of the present invention, the plurality of shingles are coupled to the second section to form a wind resistant bond.

In accordance with another feature of the present invention, the wind-resistant roof underlayment includes a substantially level partition.

In accordance with another feature of the present invention, the wind-resistant roof underlayment has a substantially uniform thickness spanning the length of the wind-resistant roof underlayment.

The present invention, according to another embodiment, includes a method of installing a roof underlayment, where the method includes providing a wind-resistant roof underlayment having a lower surface including a lower surface adhesive and a lower surface release liner coupled to the adhesive. The wind-resistant roof underlayment also includes an upper surface having a first edge and a second edge. The first edge and the second edge are separated by a width. The wind-resistant roof underlayment further includes a first portion having a first width and a second portion having a second width, larger than the first width. A release liner portion covers the second portion and is disposed in an overlapping relationship with an upper surface adhesive medium coupled to the upper surface. The method includes removing the lower surface release liner and coupling the lower surface of the wind-resistant roof underlayment directly to a roof deck, with the first edge of the upper surface at a position substantially adjacent to an eave of a roof deck. The method continues by removing the release liner portion, thereby exposing an adhesive strip of the upper surface adhesive medium; and coupling a plurality of shingles to the adhesive strip of the upper surface adhesive medium.

In accordance with another feature of the present invention, the first portion and the second portion are separated by a partition.

In accordance with yet another feature of the present invention, the partition is substantially level.

In accordance with an additional feature of the present invention, the first portion, the second release liner portion, and the partition form an elongated sheet having a substantially uniform thickness extending a longitudinal length of the wind-resistant underlayment.

Although the invention is illustrated and described herein as embodied in a method of installing a wind-resistant roof underlayment, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of a roof.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
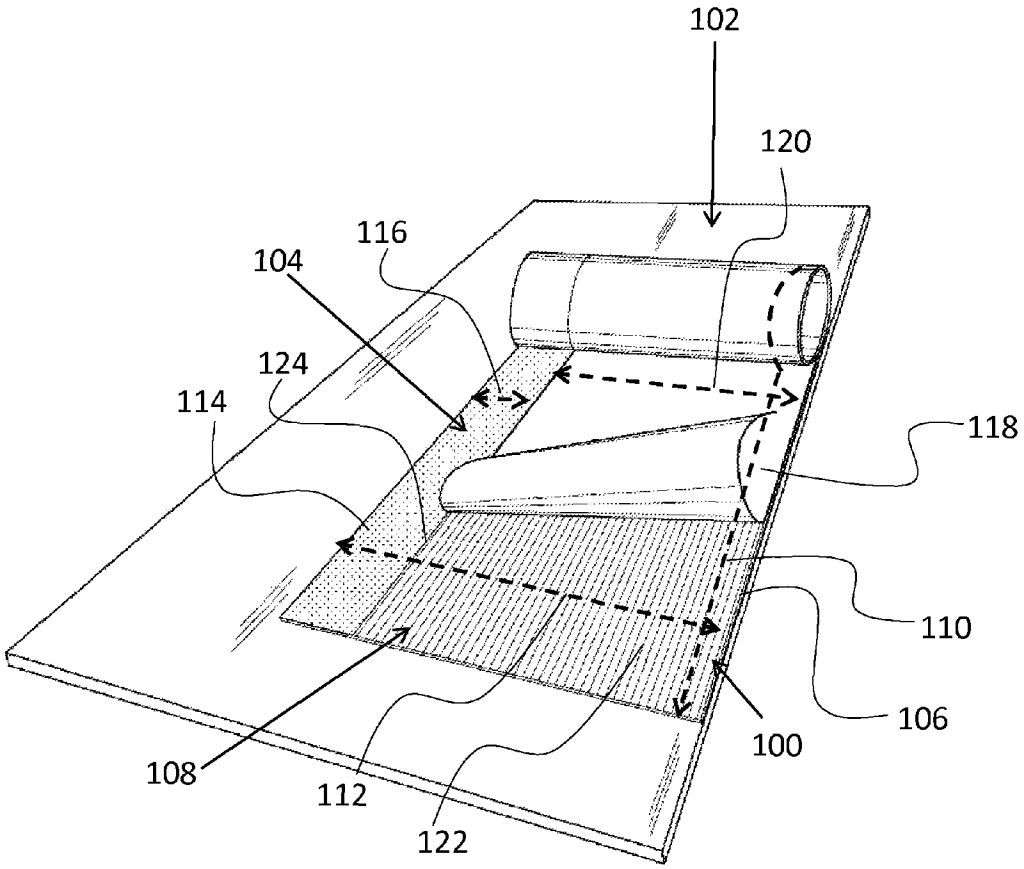
FIG. 1 is a perspective view of an upper surface of a wind resistant roof underlayment showing the wind resistant roof underlayment coupled to a roof deck in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient method of installing a wind-resistant roof underlayment at the eave of a roof deck. The term "eave" is generally understood in the art as the portion of the roof having an edge extending over or at the exterior wall of a building structure. For the purpose of this application, the eave may also include the "rake," or the outer edge of the roof that runs form the eave to the ridge or peak of the roof. Embodiments of the present invention provide the wind-resistant roof underlayment having a lower surface and an upper surface. In one embodiment, the lower surface includes a liner that may be removed to expose an adhesive medium which binds to the roof deck. The upper surface includes at least two sections separated by a partition. The first section is void of an adhesive and may be made of a waterproof material and the second section includes a release liner. The release liner may be removed at a desired time to bind the second section to roofing materials, e.g., a plurality of shingles, in a wind-resistant manner to prevent the shingles from flying off of the roof. The wind-resistant underlayment also provides temporary weather protection until such time as the plurality of shingles are installed, and provides a secondary weatherproofing barrier if moisture infiltrates the shingles.

Figure 2:
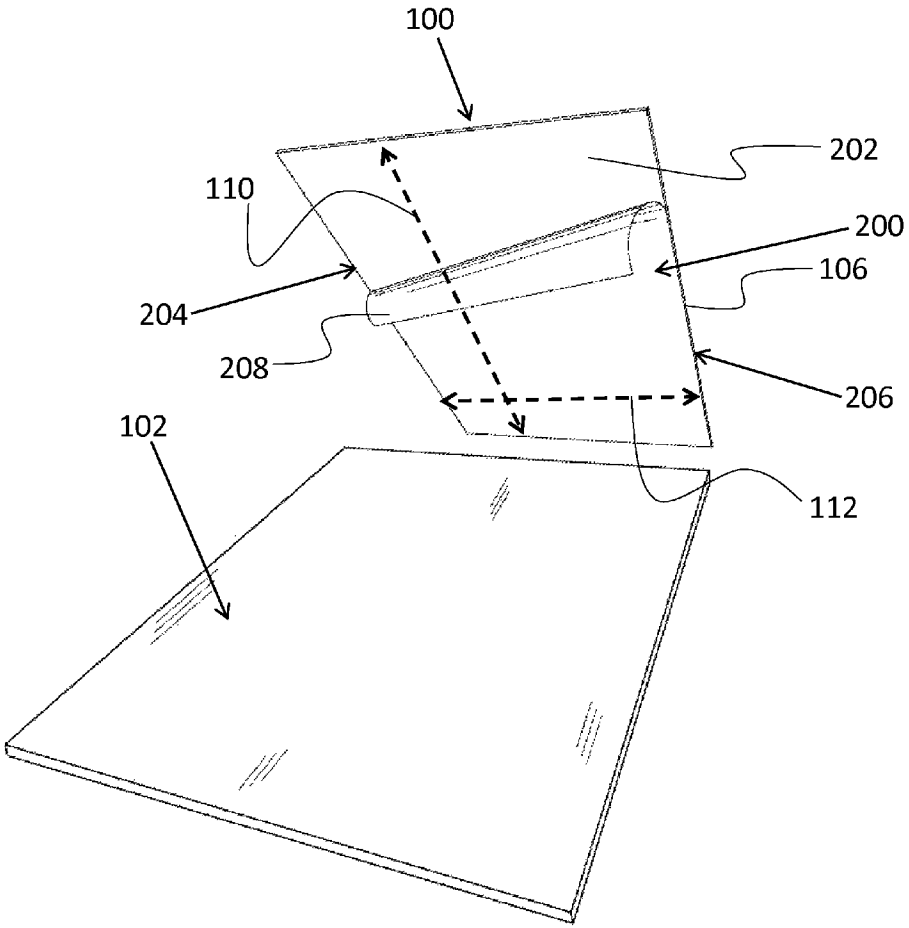
FIG. 2 is a perspective view of a lower surface of the wind resistant roof underlayment of FIG. 1 showing the lower surface prior to the lower surface being coupled to the roof deck.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a wind-resistant roof underlayment 100, as shown in FIG. 1, depicts the wind-resistant roof underlayment 100 coupled to a roof deck 102. The wind-resistant roof underlayment 100 may be referred to herein as the underlayment 100. In one embodiment, the underlayment 100 includes an upper surface 104. In one embodiment, the upper surface 104 may be the upper surface of an inner core 106 that is interposed between the upper surface 104 and a lower surface 200 (as shown in FIG. 2). In another embodiment, the upper surface 104 may be an upper layer, i.e., a separate and distinct layer from the inner core 106.

The upper surface 104 includes an upper surface adhesive medium 108 coupled thereto. In a preferred embodiment, the upper surface adhesive medium 108 is disposed continuously along a longitudinal length 110 of the underlayment 100. The term "continuously" is defined herein as extending along the entire longitudinal length 110, i.e., void of any gaps throughout the longitudinal length 110 of the underlayment 100. In another embodiment, the upper surface adhesive medium 108 may be disposed along a portion of the upper surface 104 that is less than the longitudinal length 110 of the underlayment 100. In one embodiment, the longitudinal length 110 is between 36 feet to 40 feet in length. In another embodiment, the longitudinal length 110 is between 66 feet to 72 feet in length. In another embodiment, the longitudinal length 110 may be outside of these ranges, depending on the overall length of the roof deck 102.

The upper surface adhesive medium 108 can by any suitable adhesive element for securely adhering the underlayment 100 to roofing materials, e.g., the plurality of shingles, to form a wind-resistant bond between the underlayment 100 and the roofing materials. In one embodiment, the upper surface adhesive medium 108 is a bitumen-based adhesive, e.g., SBS modified bitumen. In another embodiment, the upper surface adhesive medium 108 may be a water-based acrylic adhesive, a solvent based adhesive, an asphalt based adhesive, or the like. Advantageously, the upper surface adhesive medium 108 eliminates the need for the use of roofing cement during the roof installation process. As such, the present invention provides a cleaner, safer, and more efficient roof installation method than existing methods utilizing roofing cement. More specifically, the present invention eliminates the risk of workers stepping on and adhering to the roofing cement. The present invention also provides a cleaner work environment by eliminating the need for the roofing cement that often adheres to the user's shoes, nails, nail guns, hammers, and other roofing materials present during roofing installation. As an added advantage, the hazards associated with the roofing cement are eliminated.

Referring still to FIG. 1, the underlayment 100 is depicted having a width 112 of approximately eleven to fifteen inches. In yet another embodiment, the width 112 may be approximately thirty-six to thirty-nine inches. In other embodiments, the width 112 may be outside of these ranges. Advantageously, the width 112 complies with the width required by certain building codes, such as the Florida Building Code's Roofing Application Standard (RAS) No. 115, section 6.1.

The underlayment 100 includes a first non-release liner portion 114, i.e., first section, spanning the longitudinal length 110 of the underlayment 100. In one embodiment, the first non-release liner portion 114 may be a width 116 of at least three inches. In a preferred embodiment, the width 116 is approximately three inches. The term "approximately" is defined herein as plus or minus one inch. In other embodiments, the width 116 may be outside of these ranges.

The first non-release liner portion 114 is void of any adhesive. Advantageously, this prevents the user from stepping on and sticking to the first non-release liner portion 114. In one embodiment, the first non-release liner portion 114 made be made of a granular material. In another embodiment, the first non-release liner portion 114 may be made of felt paper. In other embodiments, the first non-release liner portion 114 may be made of an ice-and-water shield or another waterproof material.

FIG. 1 shows a second release liner portion 118, i.e., release liner, spanning the longitudinal length 110 of the underlayment 100. In one embodiment, the second release liner portion 118 includes a width 120 that is at least eight inches. In another embodiment, the width 120 may be approximately eight to twelve inches. The term "approximately" is defined herein as plus or minus one inch. In another embodiment, the width 120 may be approximately thirty-six to thirty-nine inches. In other embodiments, the width 120 may be outside of these ranges.

The second release liner portion 118 is disposed in an overlapping relationship with an adhesive strip 122 of the upper surface adhesive medium 108. The adhesive strip 122 may represent the second section of the upper surface 104 of the underlayment 100. The second release liner portion 118 covers the adhesive strip 122 up to the point in time in which the user is ready to bind the appropriate roofing materials to the upper surface adhesive medium 108. Advantageously, the user can complete different stages of the roof installation at different times. This can be especially valuable during unforeseen circumstances that delay the roofing installation process, such as inclement weather.

The second release liner portion 118, because it is generally known in the art, will not be discussed in detail, but is generally defined as at least one of a paper-based or plastic-based carrier web material that is coated with a release agent that provides a release effect against the upper surface adhesive medium 108.

In one embodiment, the first non-release liner portion 114 and the second release liner portion 118, in combination with the underlying adhesive strip 122, are separated by a partition 124. In one embodiment, the partition 124 may be a recessed partition. The term "recessed" is defined herein as at least one of an indentation, dent, and depression that provides the user with a visual indication of where the different roofing materials, e.g., secondary underlayment and shingles, are to be placed. Advantageously, the user does not have to spend valuable installation time measuring the diameters of the underlayment 100 in order to determine where to couple the roofing materials thereto.

In another embodiment, the partition 124 may be substantially level. The term "substantially level" is defined herein as having a flat and even surface with no slopes or bumps. In one embodiment, the partition 124 may be of a width that is approximately twenty-one to twenty-five inches. In another embodiment, the partition 124 may be a width that is approximately twenty-six to twenty-nine inches. The partition 124 may be made of a waterproof material, e.g., a granular material, a coarse material, or another type of waterproof material.

FIG. 2 is a perspective view of a lower surface 200 of the underlayment 100. In one embodiment, the lower surface 200 may be the lower surface of the inner core 106. In another embodiment, the lower surface 200 may be a lower layer, i.e., a separate and distinct layer from the inner core 106. The lower surface 200 includes a lower surface adhesive medium 202 coupled thereto. In a preferred embodiment, the lower surface adhesive medium 202 is disposed continuously along the longitudinal length 110 of the underlayment 100. In another embodiment, the lower surface adhesive medium 202 may be disposed along a portion of the lower surface 200 that is less than the longitudinal length 110 of the underlayment 100.

In one embodiment, the underlayment 100 includes an upper edge 204 and a lower edge 206 separated by the width 112 of the underlayment 100. In a preferred embodiment the lower surface adhesive medium 202 spans the width 112 of the underlayment 100, i.e., from the upper edge 204 to the lower edge 206. In another embodiment, the lower surface adhesive medium 202 may span only a portion of the width 112 of the underlayment 100.

The lower surface adhesive medium 202 may be any suitable element for securely adhering the underlayment 100 to the roof deck 102. In one embodiment, the lower surface adhesive medium 202 is the same adhesive element as the upper surface adhesive medium 108 (as shown in FIG. 1). In another embodiment, the lower surface adhesive medium 202 may be a bitumen-based adhesive, a water based acrylic adhesive, a solvent based adhesive, an asphalt based adhesive, etc. The lower surface adhesive medium 202 includes a lower surface release liner 208 coupled to the lower surface adhesive medium 202. The lower surface release liner 208 maintains the same general properties as described in reference to the second release liner portion 118 (as shown in FIG. 1).

With reference to FIG. 2 in conjunction with the process flow diagram of FIG. 7, one exemplary embodiment of the invention will be described. The process of installing a wind-resistant underlayment begins at step 700 and immediately proceeds to step 702, where a wind-resistant roof underlayment, such as the wind-resistant roof underlayment 100, or underlayment 100, described above, is provided, e.g., brought into physical existence. The process proceeds to step 704 of removing the lower surface release liner 208 from the lower surface 200 of the underlayment 100.

Figure 3:
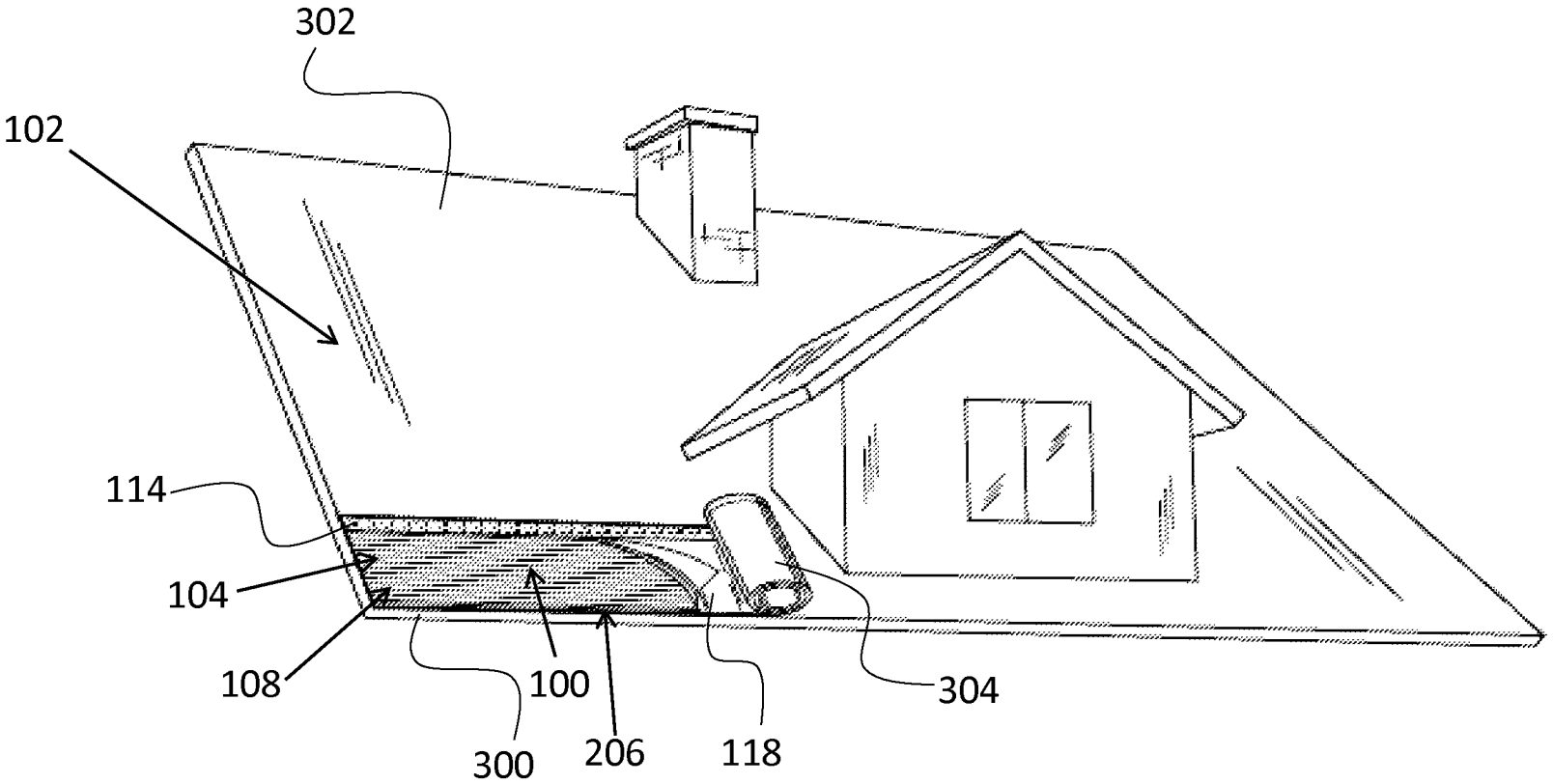
FIG. 3 is an elevational front view of an exemplary implementation of a method of installing the wind-resistant roof underlayment of FIG. 1 in accordance with one embodiment of the present invention.

The process continues to step 706 of coupling the lower surface 200 to the roof deck 102, e.g., in a peel-and-stick type fashion. FIG. 3 shows the underlayment 100 following the removal of the lower surface release liner 208 of FIG. 2 and the coupling of the lower surface 200 (also shown in FIG. 2) to the roof deck 102. In one embodiment, the underlayment 100 may form a rolled-up elongated sheet 304. The term "elongated" is defined herein as of a length that is at least twice as long as the width 112 (FIG. 1). The elongated sheet 304 may be unrolled in increments, allowing the user to apply pressure, e.g., through a roller brush, to the underlayment 100 along the increments. The pressure may assist in adhering the lower surface adhesive medium 202 (FIG. 2) to the roof deck 102.

In one embodiment, the lower surface 200 may be coupled to the roof deck 102 in increments of at least three feet. In other embodiments, the lower surface 200 may be coupled to the roof deck 102 in increments of approximately three to ten feet. In other embodiments, the lower surface 200 may be coupled to the roof deck 102 in increments outside of this range. In a preferred embodiment, the lower surface 200 (as shown in FIG. 2) is directly coupled to the roof deck 102, i.e., there are no roofing materials, e.g., other underlayment, between the lower surface 200 and the roof deck 102. In another embodiment, the roofing materials may exist between the lower surface 200 and the roof deck 102.

Advantageously, the lower surface adhesive medium 202 forms a secure bond between the lower surface 200 and the roof deck, eliminating the need for nails, fasteners, etc. to secure the underlayment 100 to the roof deck. This eliminates the risk of injury that often occurs when nails inadvertently fall from the roof deck 102 during the installation process. This also reduces the labor costs associated with fastening the roofing materials to the roof deck 102.

FIG. 3 depicts a portion of the second release liner portion 118 at a position substantially adjacent to an eave 300 of the roof deck 102, where roofing shingles are most susceptible to soaring from the roof when exposed to heavy wind. More specifically, in one embodiment, the lower edge 206 is positioned substantially adjacent to the eave 300. The term "substantially adjacent" is defined herein as within one to two inches from the eave 300 of the roof deck 102. In another embodiment, the lower edge 206 may be positioned at the eave 300 of the roof deck 102. Advantageously, the underlayment 100 is in compliance with certain building codes, such as the Florida Building Code's Roofing Application Standard (RAS) No. 115, section 6.1. Placement of the underlayment 100 at the eave 300 reduces the probability of one or more shingles, later coupled to the upper surface 104, from coming off of the roof when exposed to the heavy wind generating appreciable vertical, or uplift, forces on the shingles. As an added advantage, the placement of the underlayment 100 prevents rain from contacting the walls of the house, building, or other structure below the roof deck 102 and prevents the ingress of water at the junction where the roof deck 102 meets the walls of the structure, as commonly understood by one of ordinary skill in the art.

Figure 4:
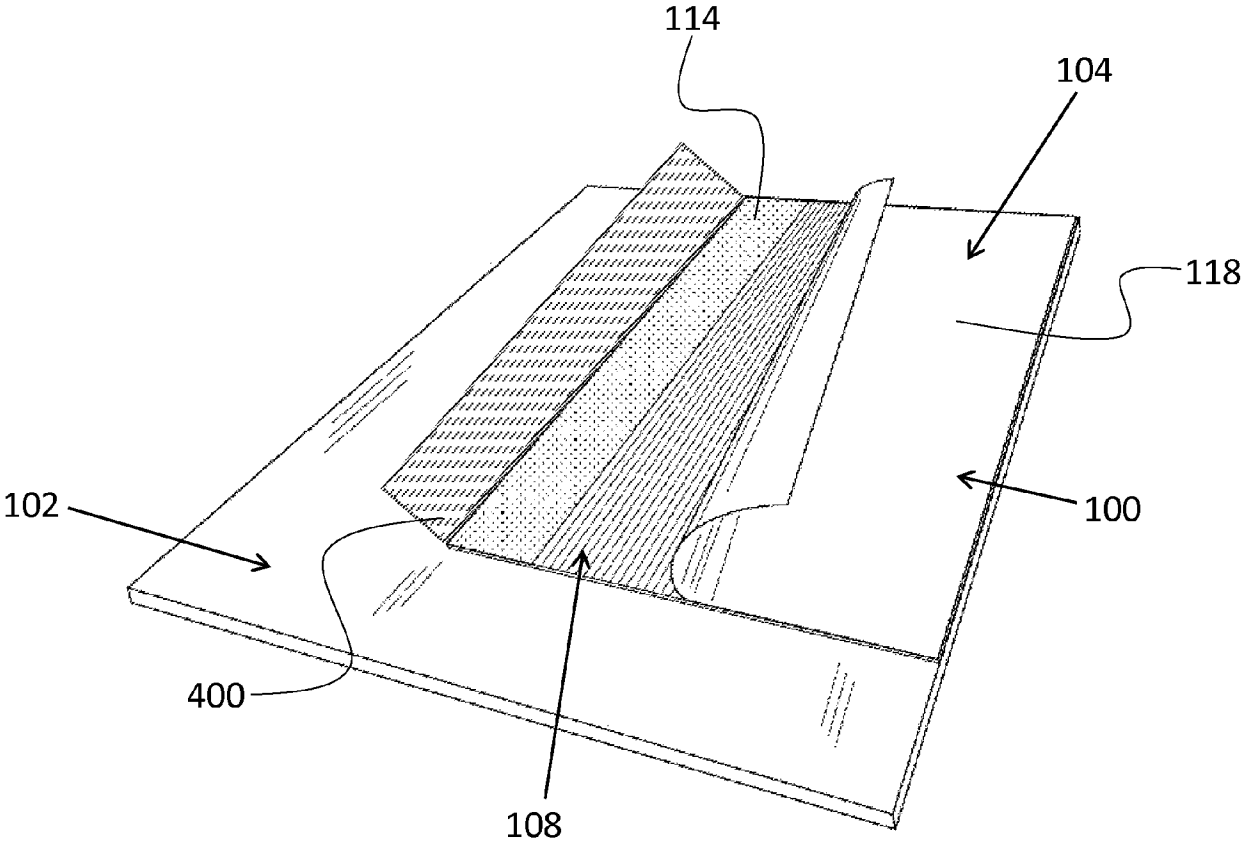
FIG. 4 is a perspective view of a first non-release liner portion of the upper surface of the wind-resistant roof underlayment of FIG. 1 showing a secondary underlayment adjacent to the first non-release liner portion of the wind-resistant roof underlayment.
Figure 7:
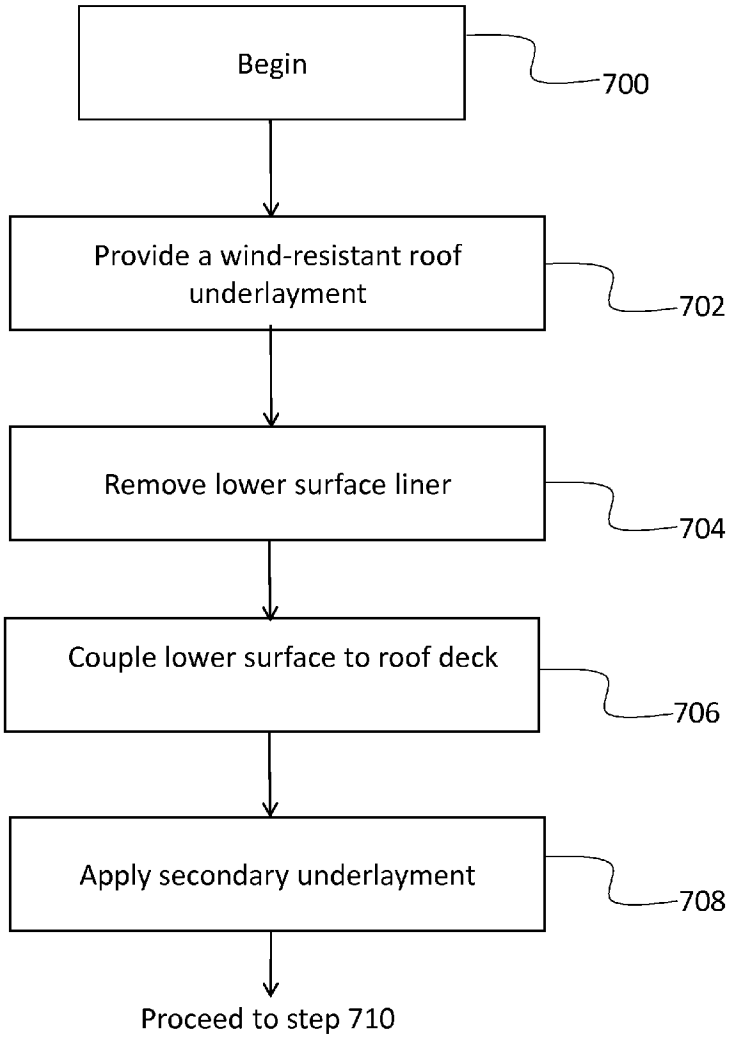
FIG. 7 is a process flow diagram of a method of installing the wind-resistant roof underlayment of FIG. 1 in accordance with one embodiment of the present invention.
Figure 8:
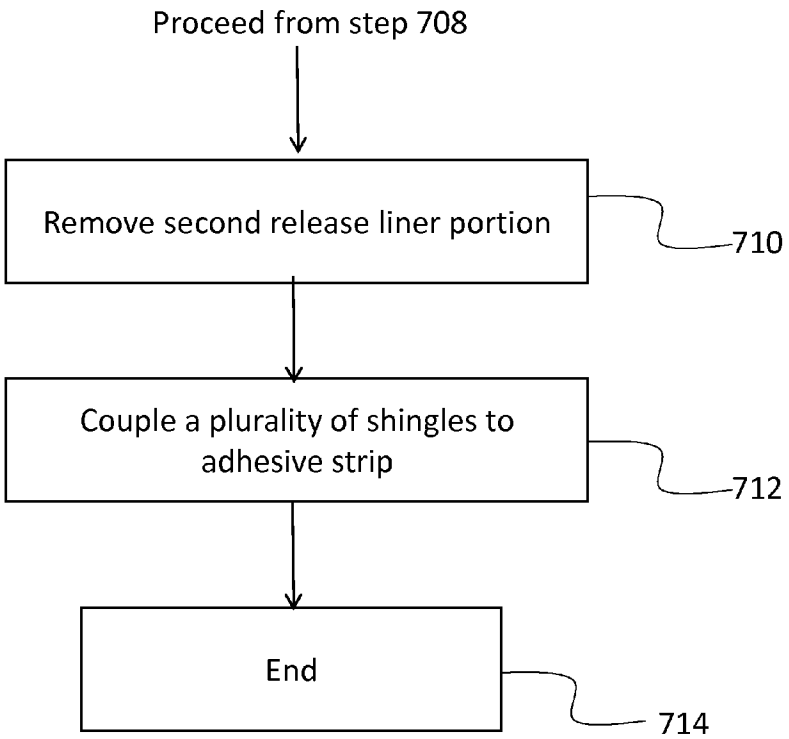
FIG. 8 is a continuation of the process flow diagram of the method of installing the wind-resistant roof underlayment of FIG. 7.

With reference to FIG. 4, in conjunction with the process flow diagrams of FIGS. 7 and 8, a perspective view of the upper surface 104 of the underlayment 100 is shown. The process continues to step 708 of applying a secondary underlayment 400 in an adjacent relationship with the first non-release liner portion 114. The term "adjacent" is defined herein as directly next to such that there is no existing spacing between or adjoining Advantageously, the secondary underlayment 400 is made of a water impermeable material to prevent water, rain, and associated elements from leaking through the roof deck 102. In one embodiment, the secondary underlayment 400 is a felt paper. In another embodiment, the secondary underlayment 400 is an ice-and-water shield. In other embodiments, the secondary underlayment 400 may be any one of a number of underlayments provided in standard roofing installation jobs, as would be understood by one of ordinary skill in the art.

In one embodiment, the process of installing the water-resistant roof underlayment continues with applying a plurality of secondary underlayments 400 to substantially cover the roof deck 102. "Substantially cover" is defined herein as covering at least eighty to ninety percent of the roof deck 102. The plurality of secondary underlayment 400 may be installed before removing the second release liner portion 118, as will be explained further herein. More specifically, the secondary underlayment 400 may applied beginning at a location adjacent to the first non-release liner portion 114 and continuing in an ascending manner to an elevated portion 302 (as shown in FIG. 3) of the roof deck 102, until the roof deck 102 is substantially covered by the secondary underlayment 400.

Figure 5:
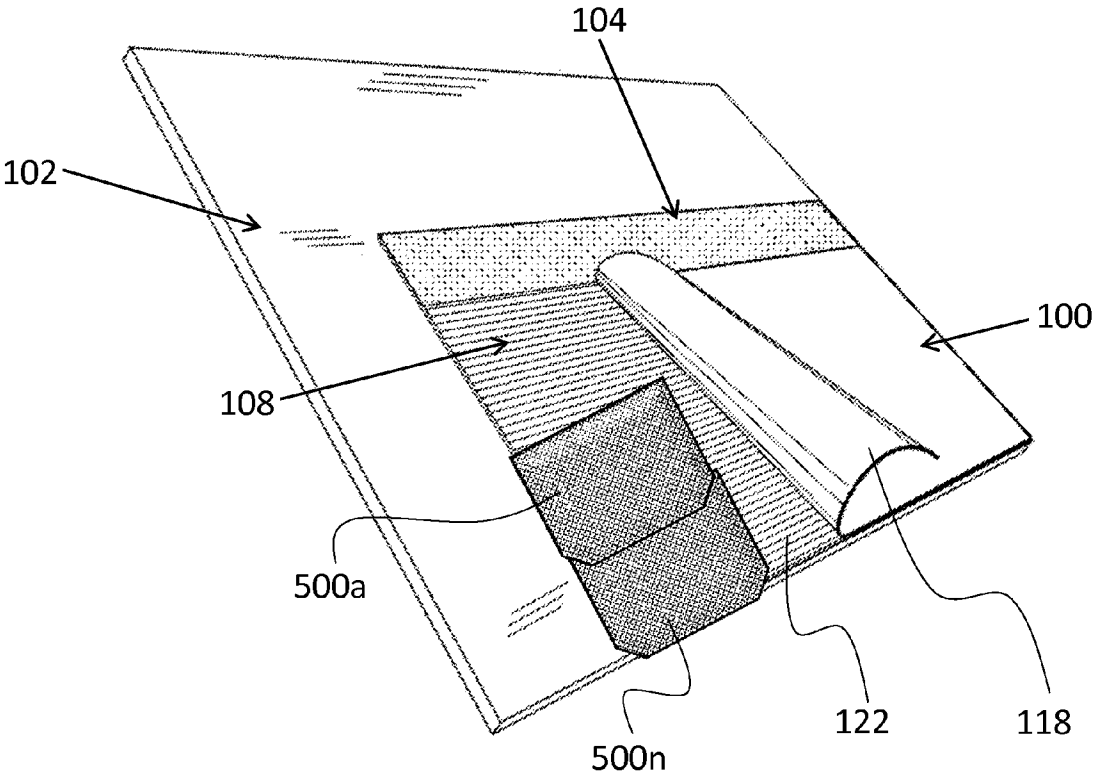
FIG. 5 is a perspective view of a second release liner portion and a second section of the upper surface of the wind-resistant roof underlayment of FIG. 1 showing a plurality of shingles coupled to the second section.

With reference to FIG. 5, depicting a perspective view of the upper surface 104 in conjunction with the process flow diagram of FIG. 8, the process continues with the step 710 of removing the second release liner portion 118 to expose the adhesive strip 122 of the upper surface adhesive medium 108. Advantageously, the second release liner portion 118 may be removed at a point in time that is hours, days, or even weeks following the placement of the underlayment 100 on the roof deck 102, in the event there is a delay in the roof installation process. As opposed to the known methods of roof installation which utilize roofing cement and require prompt placement of shingles, the second release liner portion 118 provides protection to the underlayment 100 until the user desires to remove the second release liner portion 118. As an added advantage, the user may perform work on the roof without stepping on the messy roofing cement present in other roofing installation methods, which poses a risk of injury to the user.

The process continues with the step 712 of coupling a plurality of shingles 500*a-n* to the adhesive strip 122 of the upper surface adhesive medium 108. The indicator "a-n" is intended to represent any number of items, with "a" indicating 1 and "n" indicating any number greater than 1. Advantageously, the upper surface adhesive medium 108 forms a wind-resistant bond between the shingles 500*a-n* and the adhesive strip 122 so that the shingles 500*a-n* will remain secured to the roof when subjected to the wind, rain, etc. Said another way, the shingles 500*a-n* may be directly coupled to the adhesive strip 122 of the upper surface adhesive medium 108 conducive for providing resistance to uplift forces exerted on the shingles 500*a-n*. This is especially beneficial in geographical regions, such as the state of Florida, susceptible to heavy winds, rainstorms, hurricanes, tropical storms, and the like. In one embodiment, the wind-resistant bond and the shingles 500*a-n* may be able to sustain winds of 60 miles per hour (mph) to 90 mph. In another embodiment, the wind-resistant bond and the shingles 500*a-n* may be able to sustain winds of 90 mph to 130 mph. In other embodiments, the wind-resistant bond and the shingles 500*a-n* may be able to sustain winds outside of this range. As an added advantage, the wind-resistant bond eliminates that need for the usage of nails and other hazardous roofing materials that often fall from the roof. As a further advantage, labor costs associated with picking up the nails may be eliminated.

In one embodiment, the shingles 500*a-n* can be made of an asphalt material. In another embodiment, the shingles 500*a-n* may be made of a wood material. The shingles 500*a-n* may appear as slate, scalloped, cedar shake, architectural, or may have another type of appearance, based on individual aesthetic preference. The process ends at step 714. The steps delineated in FIGS. 7 and 8 are merely the exemplary of the preferred order of installing the underlayment 100 and said steps may be carried out in another order, with or without additional steps included therein.

Figure 6:
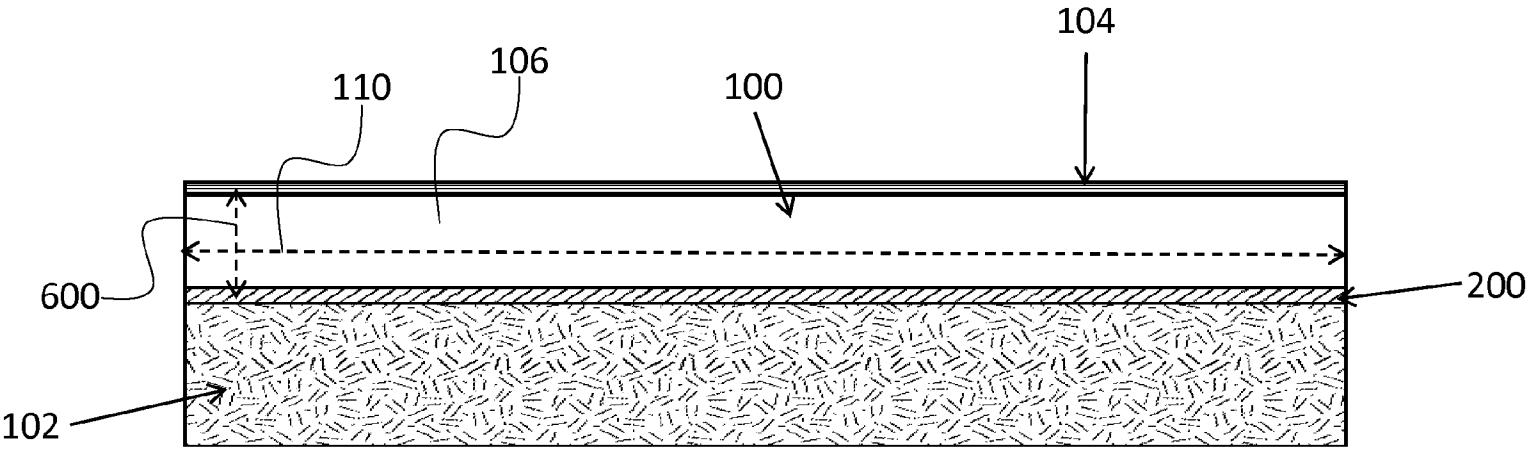
FIG. 6 is an enlarged cross-sectional view of the wind-resistant roof underlayment of FIG. 1.

FIG. 6 is an enlarged cross-sectional view of the underlayment 100 coupled to the roof deck 102. In a preferred embodiment, the underlayment 100 includes a substantially uniform thickness 600 separated by the upper surface 104 and the lower surface 200. FIG. 6 shows the inner core 106 interposed between the upper surface 104 and the lower surface 200. Said another way, the inner core 106 may bind to the upper surface 104 and the lower surface 200. The inner core 106 acts as a water-resistant barrier through the use of a material such as asphalt, thermoplastic, polyvinyl chloride (PVC), polyethylene, polyester, nylon, or the like. The term "substantially uniform," is defined herein as having a thickness that is the same along substantially the entire longitudinal length 110 of the underlayment 100. Providing the substantially uniform thickness 600 creates a more uniform appearance for the shingles 500*a-n* (as shown in FIG. 5) that is aesthetically pleasing in addition to facilitating a level installation surface that reduces the likelihood of forming recesses or pockets in the roofing structure prone to accumulation of water and debris. In another embodiment, the thickness 600 may vary throughout the longitudinal length 110. In one embodiment, the thickness 600 is at least 0.5 inches. In another embodiment, the thickness is at least 1.0 inch. In yet another embodiment, the thickness 600 may be less than 2.0 inches. In other embodiments, the thickness 600 may vary outside of these ranges.

A method of installing a wind-resistant roof underlayment 100 has been disclosed that features an upper surface having a first non-release liner portion and a second release liner portion. The second release liner portion may be removed to expose an adhesive strip having an upper surface adhesive medium that may bind to a plurality of shingles to form a wind-resistant bond.

What is claimed is:

1. A method of installing a wind-resistant roof underlayment, the method comprising:
- providing a wind-resistant roof underlayment having:
  - a lower surface including a lower surface adhesive medium and a lower surface release liner coupled thereto;
  - an upper surface including:
    - a first non-release liner portion spanning a longitudinal length of the wind-resistant roof underlayment, having a width of the wind-resistant roof underlayment of at least three inches; and
    - a second release liner portion spanning a longitudinal length of the wind-resistant roof underlayment, having a width of the wind-resistant roof underlayment of at least eight inches, the second release liner portion disposed in an overlapping relationship with an upper surface adhesive medium coupled to the upper surface; and
    - a partition separating the first non-release liner portion and the second release liner portion; and
  - an inner core interposed between the lower and upper surfaces;
- coupling the lower surface of the wind-resistant roof underlayment to a roof deck, with a portion of the second release liner portion of the upper surface at a position substantially adjacent to an eave of the roof deck;
- removing the second release liner portion, thereby exposing an adhesive strip of the upper surface adhesive medium; and
- coupling a plurality of shingles to the adhesive strip of the upper surface adhesive medium.

2. The method according to claim 1, wherein:
- the lower surface of the wind-resistant roof underlayment is directly coupled to the roof deck.

3. The method according to claim 1, wherein the wind-resistant roof underlayment further comprises:
- an upper edge and a lower edge separated by the width of the wind-resistant roof underlayment, the lower surface adhesive medium spanning the width from the upper edge to the lower edge and spanning the longitudinal length of the wind-resistant roof underlayment.

4. The method according to claim 3, further comprising:
- positioning the lower edge of the wind-resistant roof underlayment at the eave of the roof deck.

5. The method according to claim 1, further comprising:
- applying a secondary underlayment in an adjacent relationship with the first non-release liner portion, wherein the secondary underlayment is a water impermeable material.

6. The method according to claim 1, wherein:
- the partition is a recessed partition.

7. The method according to claim 1, wherein:
- the partition is a substantially level partition.

8. The method according to claim 1, further comprising:
- applying a plurality of secondary underlayments to substantially cover the roof deck before removing the second release liner portion.

9. The method according to claim 1, wherein:
- the wind-resistant roof underlayment has a substantially uniform thickness.

10. A method of installing a wind-resistant roof underlayment, the method comprising:
- providing a wind-resistant roof underlayment having:
  - a lower layer including an adhesive element disposed continuously along a length of the wind-resistant roof underlayment and a release liner covering the lower layer; and
  - an upper layer including:
    - a first section having a width of approximately three inches and a second section having a width of at least eight inches, the second section having a release liner covering the second section;
    - a partition separating the first section and the second section; and
    - an adhesive element coupled to the second section and disposed continuously along the length of the wind-resistant roof underlayment;
- coupling the lower layer to a roof deck at an eave of the roof deck;
- removing the release liner from the second section; and
- coupling a plurality of shingles to the second section.

11. The method of claim 10, wherein:
- the lower layer is directly selectively coupled to the roof deck.

12. The method of claim 10, further comprising:
- providing a secondary underlayment different than the wind-resistant roof underlayment; and
- applying the secondary underlayment adjacent the first section of the wind-resistant roof underlayment.

13. The method of claim 12, wherein:
- the secondary underlayment is at least one of an ice-and-water shield and a felt paper.

14. The method of claim 10, wherein:
- the plurality of shingles coupled to the second section forms a wind resistant bond.

15. The method of claim 10 wherein:
- the partition includes a substantially level surface.

16. The method of claim 10 wherein:
- the wind-resistant roof underlayment has a substantially uniform thickness spanning the length of the wind-resistant roof underlayment.

17. A method of installing a roof underlayment, the method comprising:
- providing a wind-resistant roof underlayment having:
  - a lower surface including a lower surface adhesive and a lower surface release liner coupled to the adhesive;
  - an upper surface including:
    - a first edge and a second edge, the first edge and the second edge separated by a width;
    - a first portion having a first width and a second portion having a second width, larger than the first width, a release liner portion covering the second portion and disposed in an overlapping relationship with an upper surface adhesive medium coupled to the upper surface; and
    - a partition separating the first portion of the wind-resistant roof underlayment and the second portion of the wind-resistant roof underlayment;

removing the lower surface release liner;

coupling the lower surface of the wind-resistant roof underlayment directly to a roof deck, with the first edge of the upper surface at a position substantially adjacent to an eave of a roof deck;

removing the release liner portion, thereby exposing an adhesive strip of the upper surface adhesive medium; and coupling a plurality of shingles to the adhesive strip of the upper surface adhesive medium.

18. The method according to claim 17, wherein:

the partition is a substantially level partition.

19. The method according to claim 18, wherein:

the first portion, the second portion, and the partition form an elongated sheet having a substantially uniform thickness extending a longitudinal length of the wind-resistant underlayment.

* * * * *